US006708633B2

(12) United States Patent
Ochi et al.

(10) Patent No.: US 6,708,633 B2
(45) Date of Patent: Mar. 23, 2004

(54) METHOD FOR SEAMING LINKING LOOPS ON KNITTED FABRICS

(75) Inventors: Naomasa Ochi, Nara-ken (JP); Ryosuke Mori, Nara-ken (JP)

(73) Assignee: Dan Co., Ltd., Osaka-fu (JP)

( * ) Notice: Subject to any disclaimer, the term of this patent is extended or adjusted under 35 U.S.C. 154(b) by 0 days.

(21) Appl. No.: 10/459,551

(22) Filed: Jun. 12, 2003

(65) Prior Publication Data

US 2004/0003765 A1 Jan. 8, 2004

(30) Foreign Application Priority Data

Jul. 2, 2002 (JP) ..... 2002-194013

(51) Int. Cl.[7] ..... D05B 7/00

(52) U.S. Cl. ..... 112/475.17; 112/27

(58) Field of Search ..... 112/475.17, 475.02, 112/27, 25; 66/8, 13; 700/141

(56) References Cited

U.S. PATENT DOCUMENTS 5,487,281 A * 1/1996 Frullini et al. ..... 66/13
6,397,121 B1 * 5/2002 Kawamura et al. ..... 700/141

* cited by examiner

*Primary Examiner*—Peter Nerbun
(74) *Attorney, Agent, or Firm*—Keating & Bennett, LLP

(57) ABSTRACT

A sewing method allows firm seaming to be performed without inserting point needles through linking loops that are formed near the ends of the course direction, and the other linking loops can be automatically linked with efficiency. The sewing method seams knitted fabrics having linking loops on their top courses, the knitted fabrics being stretched in the course direction with point needles inserted through some successive ones of the linking loops, wherein the point needles are pulled out with the knitted fabrics sandwiched and held in the vicinity of the linking loops across the course direction. Then, linking loops not having been pierced with the point needles are seamed at intervals smaller than the intervals of arrangement of the linking loops not having been pierced with the point needles. The linking loops pierced with the point needles are seamed by linking.

3 Claims, 8 Drawing Sheets

METHOD FOR SEAMING LINKING LOOPS ON KNITTED FABRICS

BACKGROUND OF THE INVENTION

1. Field of the Invention

The invention relates to a sewing method, and more particularly to a sewing method that is capable of reliably sewing linking loops formed on knitted fabrics such as a circular knitted fabric and a flat knitted fabric.

2. Description of the Prior Art

Knitted fabric, or material of knitted articles, is provided with a loose course made of linking loops for the sake of proper linking to a predetermined size and shape. For linking, machine seaming is performed by utilizing a guide groove of point needles which are inserted through the linking loops. The linking has been performed by an operator checking the linking loops visually and inserting the point needles of the linking machine through the linking loops before machine seaming. This method, however, has required a lot of skills to insert the point needles through the linking loops. There are not many operators who are capable of performing such a high skill operation. Moreover, even those operators that are highly skilled sometimes make an insertion through the wrong loops, with the result of linking with some loops dropped. In view of the foregoing problems, linking apparatuses have been invented as disclosed in Japanese Patent Laid-Open Publications Nos. Hei 11-207061 and Hei 11-207062. In such apparatuses, the knitted fabric is stretched in its course direction and wale direction to extend the linking loops, and images of the linking loops are captured and processed to detect the linking loops so that point needles are inserted therethrough for automatic linking.

In such linking apparatuses, however, the detection of the linking loops consumes much time. Besides, inserting the point needles through the linking loops requires successive adjustments to the relative position between the linking loops and the point needles. Quick linking has thus been impossible.

Moreover, linking loops lying near the ends of the course direction are difficult to detect since the linking loops are often stretched askew under uneven stretching tensions. This problem becomes noticeable particularly in the case of circular knitted fabric since the knitted fabric having a cylindrical shape is rendered flat. Furthermore, when the circular knitted fabric is a stocking, a toe gore line is formed near the linking loops. Since the knit loops which are larger than the linking loops are arranged in the vicinity of the linking loops, the detection has been extremely difficult. Thus, the operator has had to check the positions of the linking loops on both sides of the knitted fabric visually and insert fixing pins which are provided in addition to the point needles. It has therefore been impossible to fully automate the linking operation.

In the cases of linking by manual operation or by using the linking apparatuses described above, there will occur the problems of a raveling thread from the ends and a loosening seam since the starting portion and end portion of the seam are not terminated firmly due to the linking technique of threading the linking loops. On the other hand, if this problem is dealt with by means of Rosso seaming, a method of overlooking, then the thread-seamed part can form a ridge which causes deterioration in the fit of the garment.

SUMMARY OF THE INVENTION

In order to overcome the problems described above, preferred embodiments of the present invention provide a sewing method in which firm seaming can be performed without inserting point needles through linking loops that are formed near the ends of the course direction, and the other linking loops can be automatically linked with efficiency.

According to a first preferred embodiment of the present invention, a sewing method for seaming knitted fabrics having linking loops on their top courses, the knitted fabrics being stretched in a course direction with point needles inserted through some successive ones of the linking loops, includes the steps of holding the knitted fabrics in a vicinity of the linking loops across the course direction, pulling out the point needles with the knitted fabrics being held, seaming linking loops that have not been pierced with the point needles at intervals that are smaller than the intervals at which the linking loops that have not been pierced with the point needles are provided, and seaming the linking loops that have been pierced with the point needles by linking. In this method, the knitted fabric is seamed with no point needle being inserted through the linking loops. This prevents interference between the needles of the sewing machine and the point needles. As a result, the linking loops that have not been pierced with the point needles can be seamed finer than the intervals of the knitted loops, regardless of the pitches. In addition, the linking loops that have been pierced with the point needles stand so that ones to be linked are extended in alignment with each other even after the point needles are pulled out. The linking loops can thus be seamed by linking.

It is also preferred that the method described above includes the steps of arranging the knitted fabrics between holding members for holding the knitted fabrics therebetween and locking the point needles to end surfaces of the holding members. As a result, the knitted fabric is sandwiched and held in the vicinity of the linking loops. The linking loops are thus prevented from falling easily. This also facilitates linking the linking loops.

At least one of the holding members preferably has, on the end surface thereof, a plurality of projections for making contact with a knitting yarn constituting the linking loops. The projections make contact with the knitting yarn constituting the linking loops, and thereby support the linking loops. In addition, the knitted fabric can be surely arranged in a predetermined position. This further prevents the linking loops from falling, thereby ensuring the linking of the linking loops.

The foregoing and other elements, steps, features, characteristics and advantages of the present invention will become more apparent from the following detailed description of preferred embodiments of the invention with reference to the accompanying drawings.

DETAILED DESCRIPTION OF PREFERRED EMBODIMENTS

Figure 1:
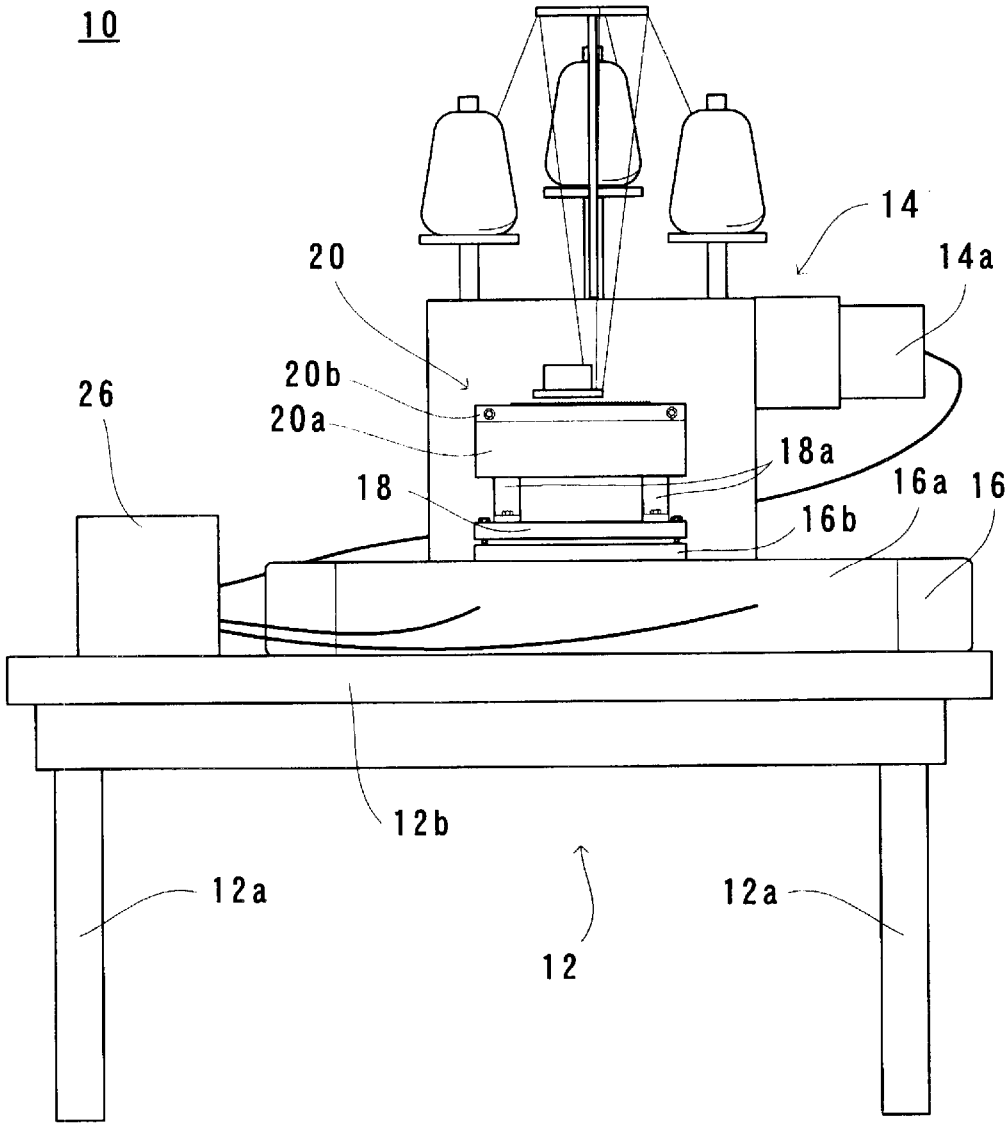
FIG. 1 is a schematic front view showing the general outline of a sewing apparatus for practicing a preferred embodiment of the sewing method according to the present invention.
Figure 2:
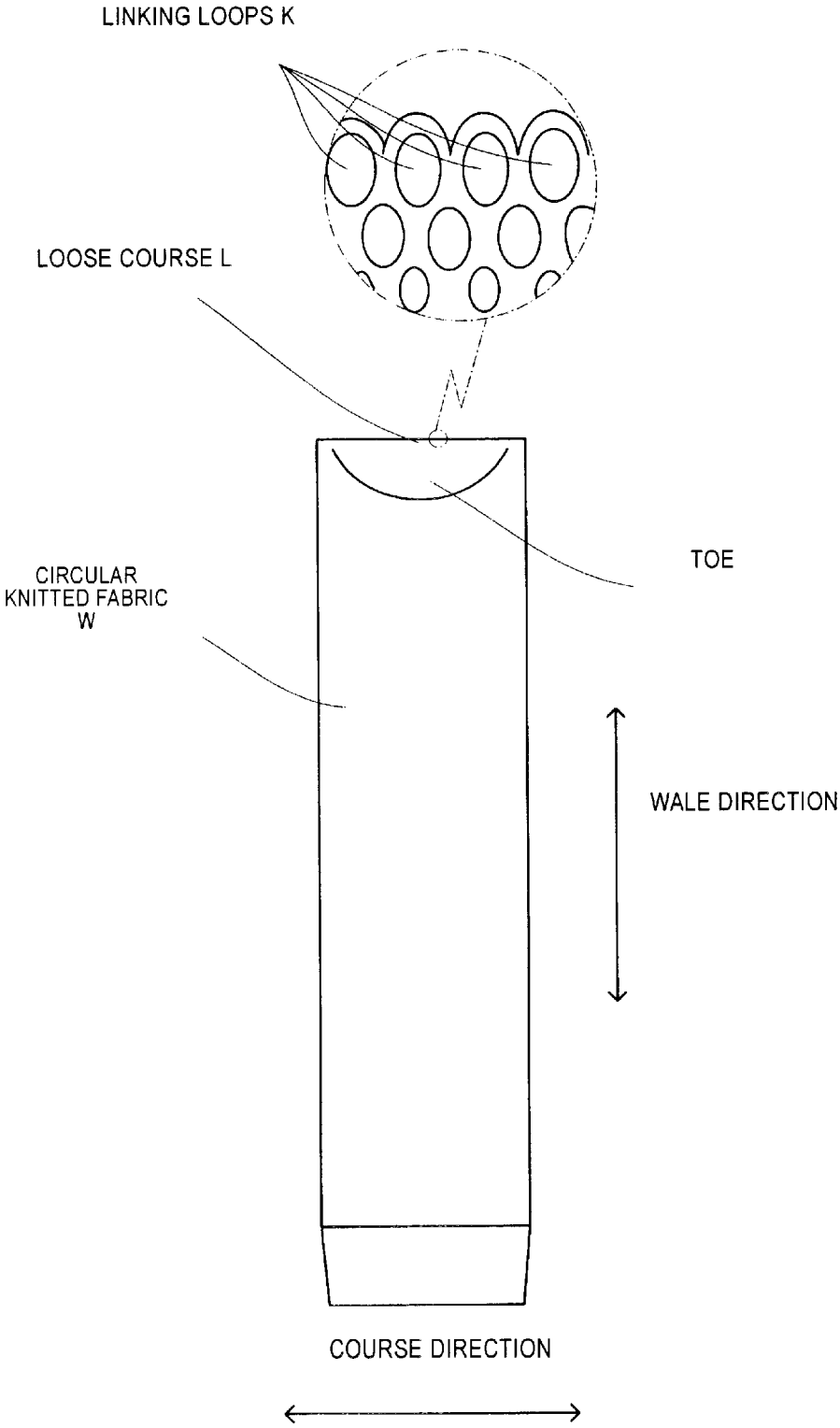
FIG. 2 is a schematic front view showing circular knitted fabric to be linked in the preferred embodiment shown in FIG. 1.
Figure 3:
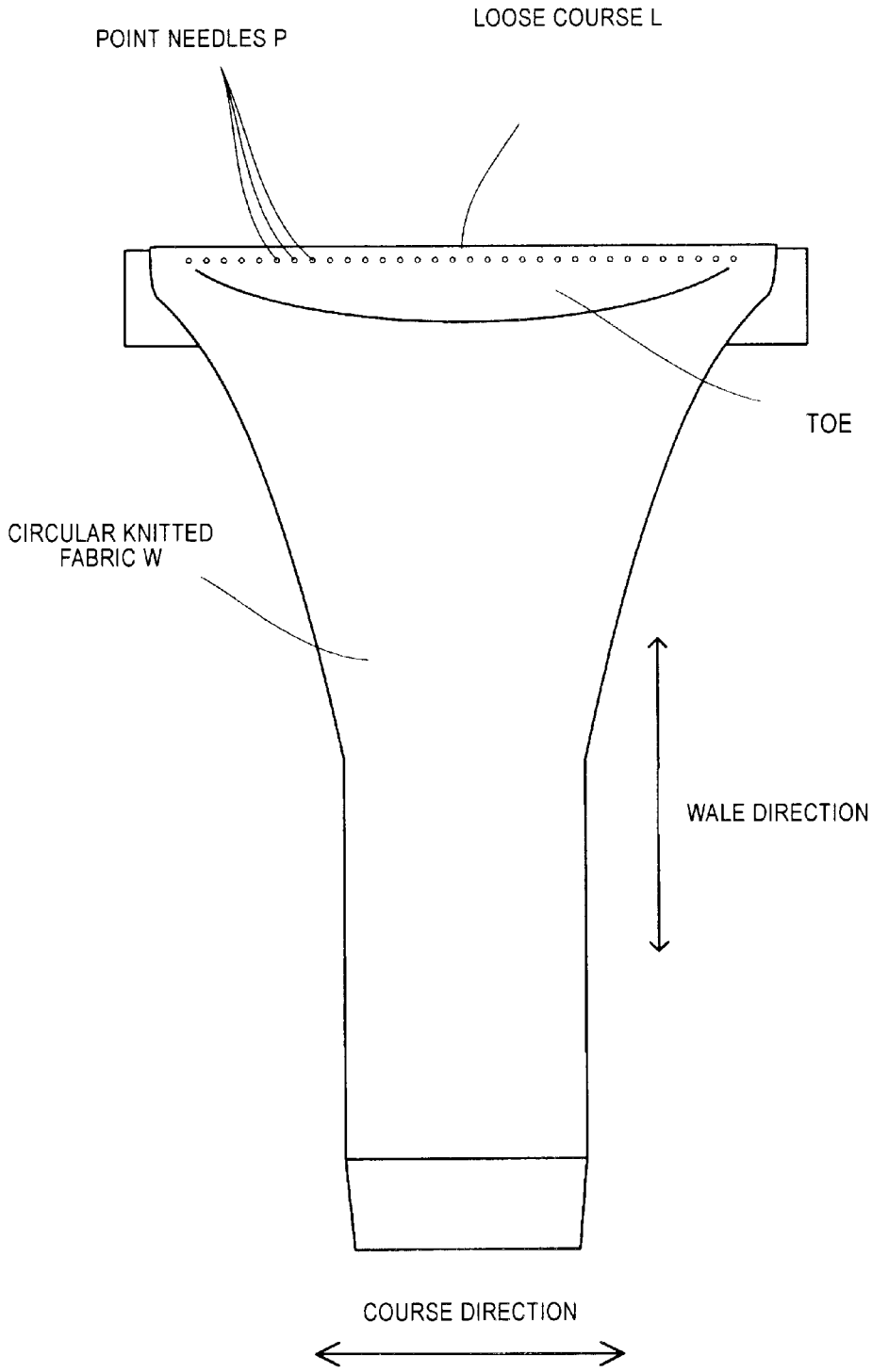
FIG. 3 is a schematic front view showing the circular knitted fabric with point needles inserted therethrough.

FIG. 1 is a schematic front view showing the general outline of a sewing apparatus for practicing a preferred embodiment of the sewing method according to the present invention. This sewing apparatus 10 is one which is optimized to seam the top (toe) of cylindrical, circular knitted fabric W as shown in FIG. 2 which is knitted by a hosiery machine.

Initially, description will be provided of the circular knitted fabric W to be sewn by the sewing apparatus 10 before giving the description of the apparatus. The circular knitted fabric W is a cut piece for a single stocking, which is cut out of circular knitted fabric that is formed continuously by the hosiery machine. By using the methods disclosed in Japanese Patent Laid-Open Publication No. Hei 11-207062 and Japanese Patent Application No. 2000-373504, the circular knitted fabric is stretched in its course direction, and in that stretched state, point needles P are inserted through all the linking loops K in succession except those lying near both ends of the fabric in the course direction. For the point needles P, ones contained in a needle box or point needle unit disclosed in the foregoing publication are used. The linking loops K lying near the both ends of the course direction, through which none of the point needles P is inserted, are determined by checking hard-to-detect linking loops K through image processing in advance.

The circular knitted fabric is made into the circular knitted fabric W by cutting out a waste course part (not shown) formed above a loose course L with a cutter or other suitable tool, as appropriate. As shown in FIG. 2, the circular knitted fabric is processed such that its top (uppermost end) in the wale direction makes the loose course L, thereby forming the circular knitted fabric W. The circular knitted fabric W is fed to this apparatus 10 while stretched in the course direction with the point needles P inserted therethrough.

The sewing apparatus 10 generally includes a table 12 for supporting machinery, a sewing machine 14 for sewing knitted fabric, a linear movement module 16 for moving the knitted fabric in the sewing direction during seaming, a holding member 20 for fixing the circular knitted fabric W, and a control unit 26 for controlling the operation of the sewing machine 14 and the linear movement module 16.

The table 12 supports the sewing machine 14 and the like at a height that is easy for an observer or others to observe the sewing apparatus 10. The table 12 includes legs 12*a* and a top 12*b*. The legs 12*a* are arranged to extend vertically downward from the four corners of the top 12*b*, and support the top 12*b* horizontally. The top 12*b* has a flat plate configuration that is oblong in the lateral direction, having a substantially rectangular shape in plan view. The sewing machine 14, the linear movement module 16, and the control unit 26 are placed on the surface of the top 12*b*.

The sewing machine 14 is installed on the far side of the top 12*b*. The sewing machine 14 seams the circular knitted fabric W at the linking loops K. The sewing machine 14 is one which seams knitted fabric along an edge thereof with two needle threads and a looper thread. The sewing machine 14 has two hook needles for running the needle threads, arranged at an identical height with a gap therebetween. The two hook needles are mounted toward the direction of the short sides of the top 12*b*. A looper needle for running the looper thread is arranged in a direction that is substantially perpendicular to the hook needles. The sewing machine 14 performs seaming by running the needle threads through the linking loops K and scooping the needle threads with the looper thread. The sewing machine 14 is driven by a driving motor 14*a*. The driving motor 14*a* is electrically connected with the control unit 26, and is driven by the control of the control unit 26. Incidentally, this preferred embodiment does not use any mechanism for feeding the knitted fabric or other processed articles, composed of conveyor chains, guide rails, and so on. The circular knitted fabric W is moved in a direction that is substantially perpendicular to the direction of insert of the hook needles by means of the linear movement module 16 and the holding member 20.

The linear movement module 16 is fixed on the near side of the top 12*b* along the longitudinal direction. The linear movement module 16 moves the holding member 20 in the direction of seaming of the knitted fabric. The linear movement module 16 generally includes a casing 16*a*, a screw shaft, a servo motor for rotating the screw shaft, a ball nut threadedly engaged with the screw shaft, and a slider 16*b* firmly attached to the ball nut. The screw shaft, servo motor, and ball nut are not shown, and are accommodated in the casing 16*a*. The servo motor is electrically connected with the control unit 26. When the servo motor is driven at an arbitrary rotation speed, the linear movement module 16 moves the slider 16*b* in the longitudinal direction of the top 12*b* by an arbitrary distance at an arbitrary speed through the action of the screw thread. Incidentally, the linear movement module 16 is not limited to such a module as described above, but may be any mechanism or apparatus as long as its operating element that is equivalent to the slider 16*b* can be moved at an arbitrary speed.

A mounting bracket 18 is attached to the slider 16*b* horizontally. The mounting bracket 18 mounts the holding member 20. Arms 18*a* are arranged on both ends of the mounting bracket 18 so as to extend vertically upward.

Figure 4:
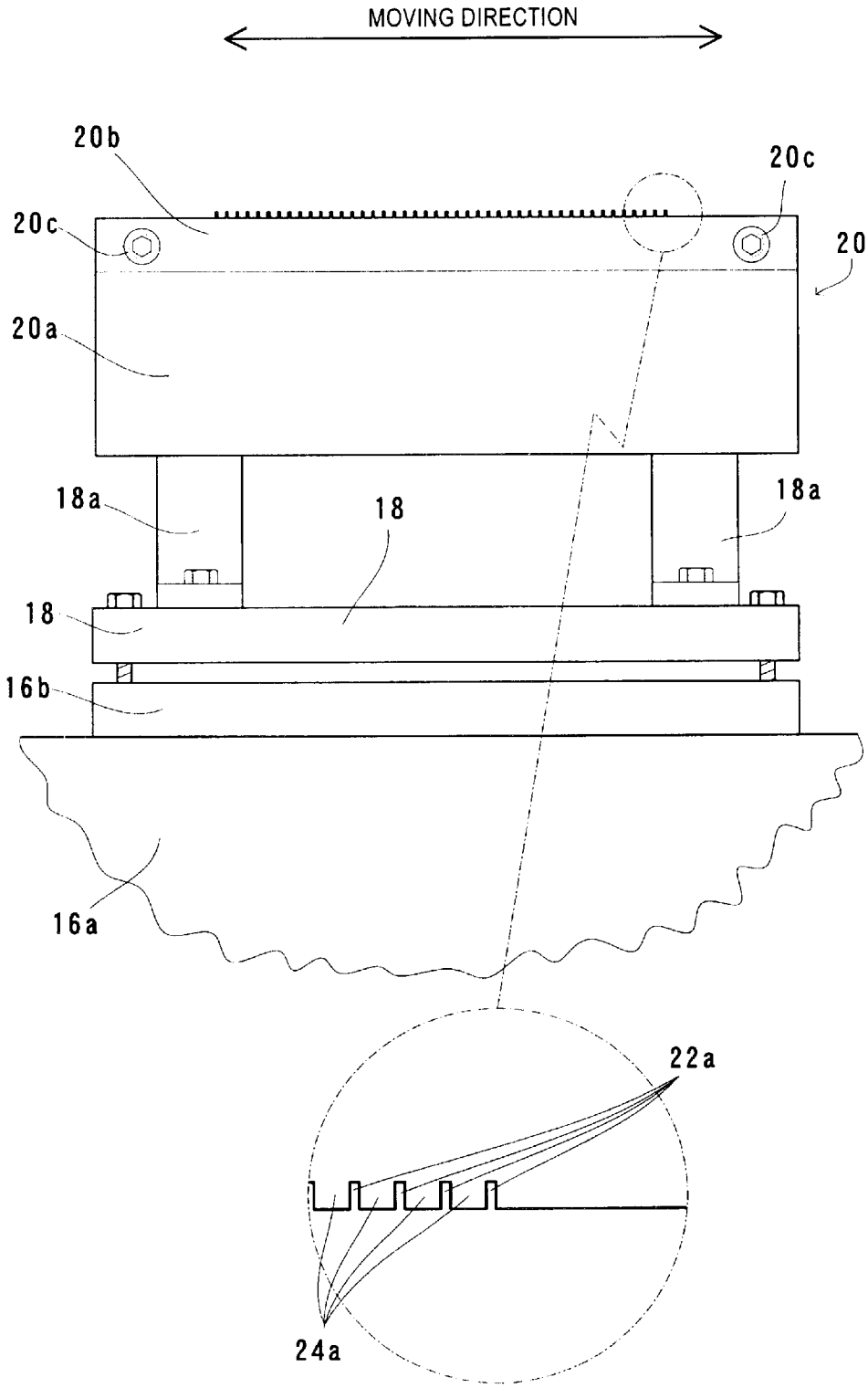
FIG. 4 is a schematic front view showing the vicinity of a holding member.
Figure 5:
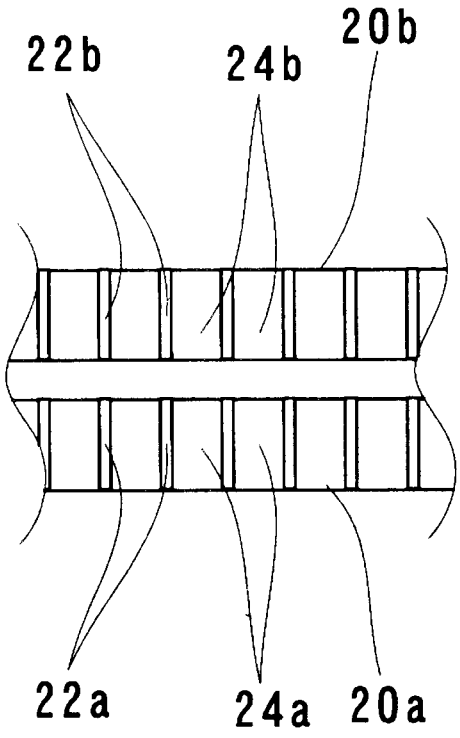
FIG. 5 is a schematic enlarged plan view of a portion of holding plates.

The holding member 20 is screwed to the arms 18*a*. The holding member 20 sandwiches and holds the circular knitted fabric W across the course direction. The holding member 20 includes holding plates 20*a*, 20*b* and screws 20*c*. The holding member 20 is horizontally mounted on the bracket 18 by the holding plate 20*a* being screwed to the arms 18*a*. The holding member 20 is preferably wider than the width of the circular knitted fabric W stretched. As shown in FIGS. 4 and 5, projections 22*a*, which have a substantially rectangular shape in longitudinal section, are disposed on the top surface of the holding plate 20*a*. The projections 22*a* are arranged in stripes extending from the front to the rear, at intervals slightly larger than the width of the point needles P. Grooves 24*a* each having a width possible for a point needle P to be loaded in are formed between the projections 22*a*. The number of projections 22*a* provided is one less than the number of point needles P, and are arranged to be sandwiched between point needles P each. Then, the point needles P on both ends adjoin only one projection 22*a* each. The projections 22*a* have such a height and width as not to cover the loops of the linking loops K of the circular knitted fabric W that is stretched in the course direction.

The holding plate 20*b* is a plate member having a wide width. The width of the holding plate 20*b* is preferably substantially the same as that of the holding plate 20*a*. The holding plate 20*b* has a height that is substantially equivalent to five or six courses of the circular knitted fabric W so as to secure a contact surface sufficient to hold the circular knitted fabric W as stretched in the course direction. As with the top surface of the holding plate 20*a*, projections 22*b* having a substantially rectangular shape in longitudinal section are formed on the top surface of the holding plate 20*b*. The projections 22*b* are arranged in stripes extending from the front to the rear, at intervals slightly larger than the width of the point needles P. Grooves 24*b* each having a width possible for a point needle P to be loaded in are formed between the projections 22*b*. Again, the number of projections 22*b* provided is one less than the number of point needles P and are arranged to be sandwiched between point needles P each. Then, the point needles P on both ends adjoin only one projection 22*b* each. The projections 22*b* also have such a height and width so as not to cover the loops of the linking loops K of the circular knitted fabric W that is stretched in the course direction.

The holding plate 20*b* is mounted by the screws 20*c* such that the positions of threaded engagement with the holding plate 20*a* can be changed easily. The holding plate 20*b* is mounted with its top surface at the same height as that of the holding plate 20*a*. As shown in FIG. 5, the holding plate 20*b* is mounted on the holding plate 20*a* such that the grooves 24*b* and the grooves 24*a* are in proper alignment with each other. The point needles P inserted through the circular knitted fabric W are loaded into the grooves 24*a* and the grooves 24*b*, so that the point needles P bridge across the top surfaces of the holding plates 20*a* and 20*b*.

Figure 6:
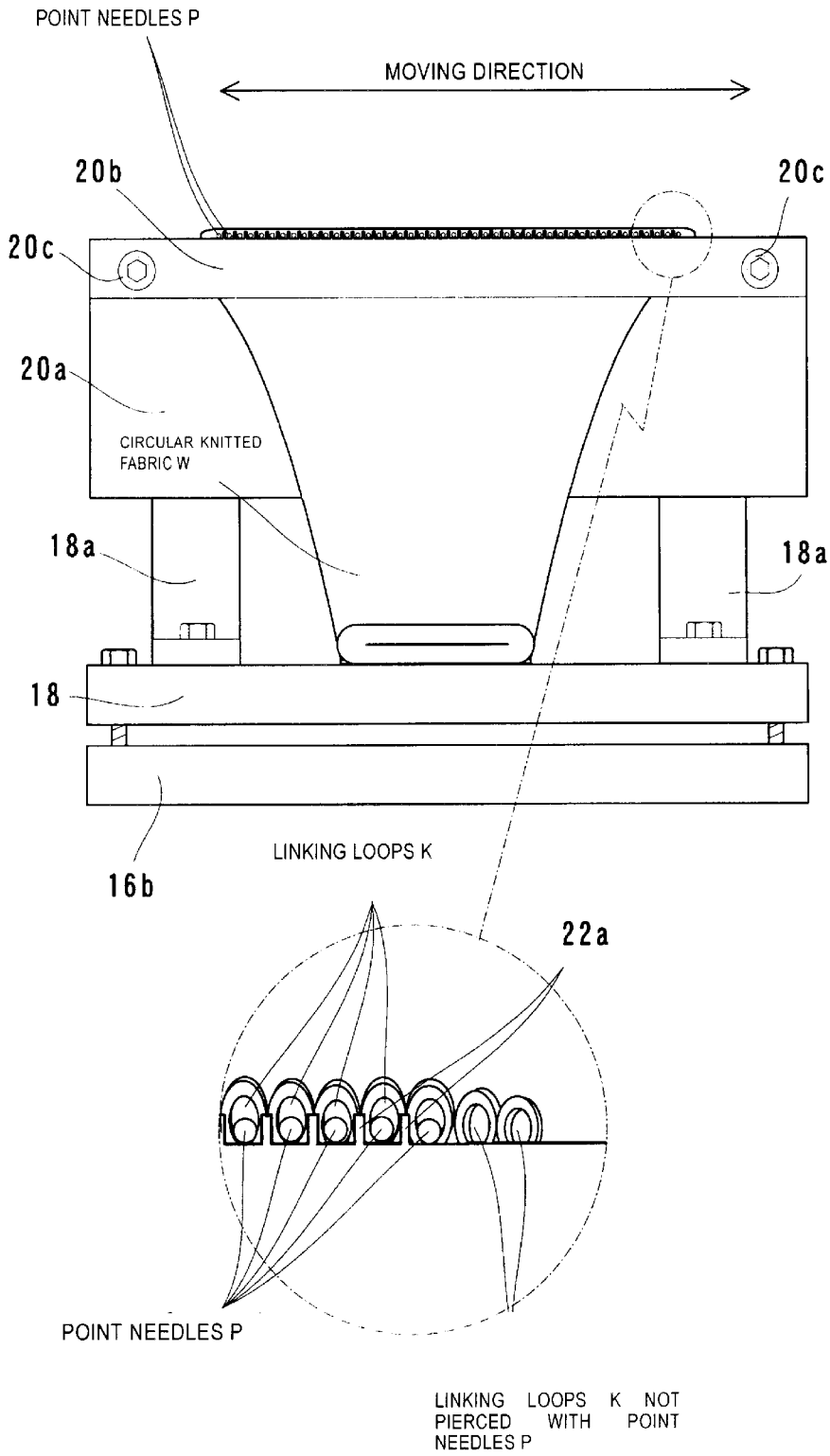
FIG. 6 is a schematic front view showing the circular knitted fabric W sandwiched and held by the holding member.

When the screws 20*c* are tightened, the holding plates 20*a* and 20*b* sandwich and hold the circular knitted fabric W which is arranged therebetween as shown in FIG. 6. By holding the circular knitted fabric W therebetween with the point needles P bridging across the grooves 24*a* and 24*b*, the holding plates 20*a* and 20*b* hold the circular knitted fabric W at the course lying under the loose course L. Here, the linking loops K pierced with the point needles P are positioned with their lowermost portions at approximately the same height as the top surfaces of the holding plates 20*a* and 20*b*. The knitting yarn constituting the linking loops K is in contact with the projections 22*a* and 22*b*. When the point needles P are pulled out horizontally in this state, the linking loops K will stand vertically with no substantial fall so that their loops open in generally elliptic shapes as shown in FIG. 6.

Incidentally, the holding plates 20*a* and 20*b* are fixed at such a height that when moved in the longitudinal direction of the top plate 12*b* by the linear movement module 16, they pass under the hook needles and the looper needle of the sewing machine 14 so that the circular knitted fabric W lying between the holding plates 20*a* and 20*b* can be sewn by the sewing machine 14.

The control unit 26 is arranged on the top 12*b*, next to the linear movement module 16. As described above, the control unit 26 is electrically connected with the driving motor 14*a* of the sewing machine 14 and the linear movement module 16. The control unit 26 includes a sequencer or computer, and controls the operation of the driving motor 14*a* and the linear movement module 16. The control unit 26 is configured such that it can move the slider 16*b* of the linear movement module 16 to a predetermined position at a predetermined speed. The control unit 26 controls the driving motor 14*a* and the linear movement module 16 so as to operate according to a predetermined sequence.

Figure 7:
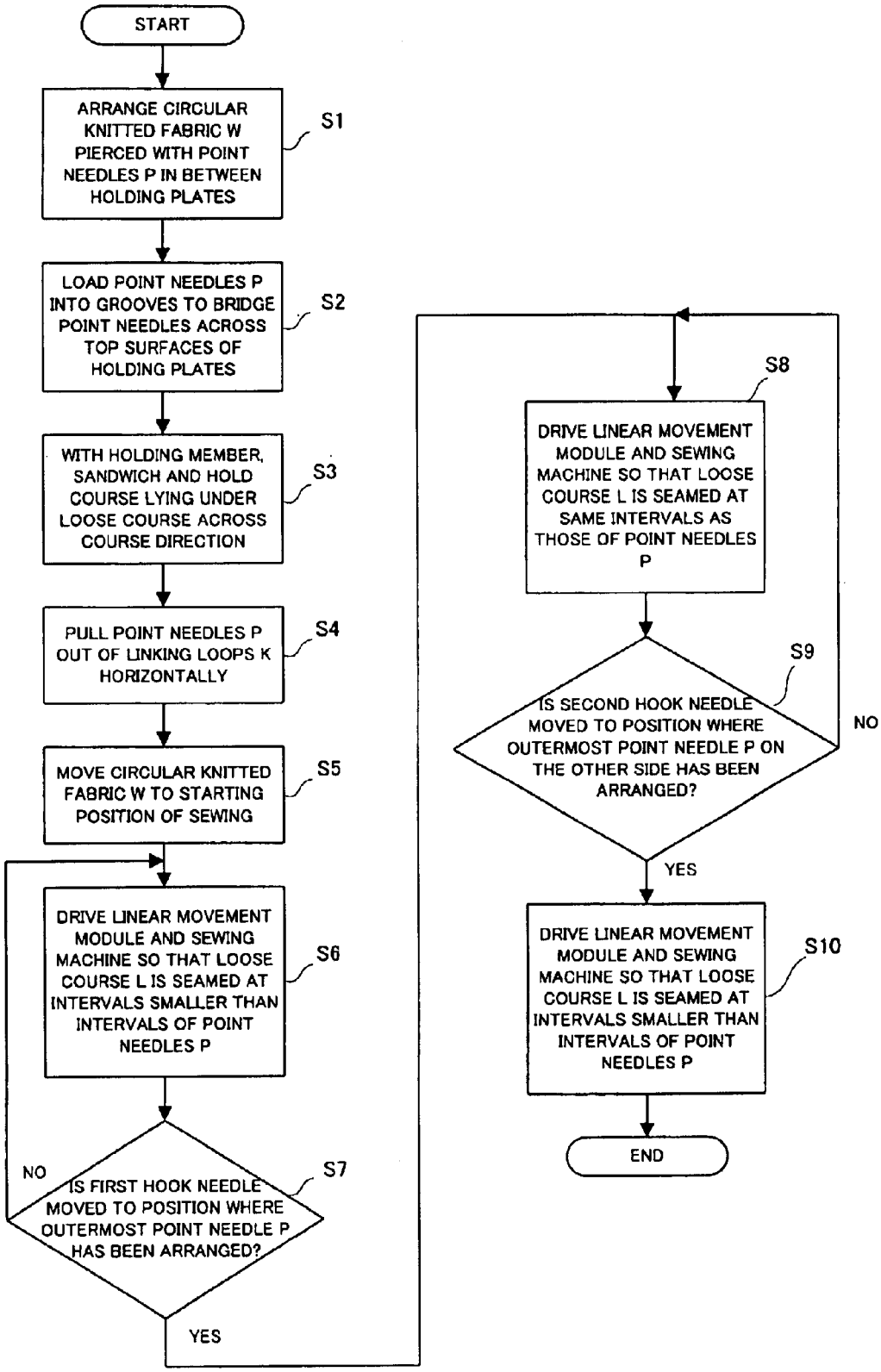
FIG. 7 is a flowchart showing the flow of operation of a preferred embodiment of the present invention.

Hereinafter, the operation of the present preferred embodiment will be described with reference to FIG. 7. In the following description, a hook needle shall refer to a first one of the hook needles of the sewing machine 14 that seams the knitted fabric for the first time, unless otherwise specified.

The operator arranges the circular knitted fabric W pierced with the point needles P in between the holding plates 20*a* and 20*b* (step S1). Here, the holding member 20 is positioned so as not to interfere with the hook needle and the like of the sewing machine 14.

The point needles P are loaded into the grooves 24*a* and 24*b*, being hung across the top surfaces of the holding plates 20*a* and 20*b* (step S2).

The operator tightens the screws 20*c*, so that the holding member 20 holds the course lying under the loose course therebetween across the course direction (step S3).

The operator pulls the point needles P out of the linking loops K horizontally (step S4). Here, as described above, the linking loops K stand nearly vertically with fine openings, except for the linking loops K that have not been pierced with the point needles P.

The operator presses a switch (not shown), which is arranged in an arbitrary position, to move the circular knitted fabric W to the starting position of sewing (step S5).

Subsequently, the control unit 26 drives the linear movement module 16 and the sewing machine 14 so that the loose course L is seamed at intervals smaller than the intervals of the point needles P (step S6). As a result, the linking loops K that have not been pierced with the point needles P are seamed by the Rosso method, ignoring the pitches. Here, the seaming intervals are predetermined depending on the type of the circular knitted fabric W to be seamed such that the knitted fabric is seamed surely with consideration given to the course-wise stretchability of the linking loops K not pierced with the point needles P. In the case of circular knitted fabric having linking loops K that do not stretch much in the course direction, the seaming intervals are smaller. With knitted fabric having linking loops K that stretch well in the course direction, the seaming intervals are larger.

While the loose course L is seamed at the intervals smaller than the intervals of the point needles P, the control unit 26 determines if the slider 16*b* is moved until the hook needle reaches the position where an outermost point needle P has been arranged (step S7).

After the slider 16*b* is moved until the hook needle reaches the position where the outermost point needle P has been arranged, the linear movement module 16 and the sewing machine 14 are driven so that the loose course L is seamed at the same intervals as those of the point needles P (step S8). Consequently, the two hook needles run the needle threads twice through each of the linking loops K that have been pierced with the point needles P. This achieves seaming by the linking method.

While the loose course L is seamed at the same intervals as those of the point needles P, the control unit 26 determines if the slider 16*b* is moved until the second hook needle, or one that runs through the knitted fabric for the second time, reaches the position where an outermost point needle P on the other side has been arranged (step S9).

After the slider 16*b* is moved until the second hook needle reaches the position where the outermost point needle P on the other side has been arranged, the linear movement module 16 and the sewing machine 14 are driven again so that the loose course L is seamed at intervals smaller than those of the point needles P (step S10). As in step S6, the seaming intervals are predetermined depending on the type of the circular knitted fabric W to be seamed such that the knitted fabric is seamed surely with consideration given to the course-wise stretchability of the linking loops K not pierced with the point needles P. In the case of circular knitted fabric having linking loops K that do not stretch much in the course direction, the seaming intervals are smaller. With knitted fabric having linking loops K that stretch well in the course direction, the seaming intervals are greater. Incidentally, the seaming intervals need not be the same as in step S6. The intervals have only to be set in accordance with the stretchability of the linking loops K to be seamed at step S10. As a result, the linking loops K that have not been pierced with the point needles P on the other side are seamed by the Rosso method.

As has been described, according to this sewing apparatus, the linking loops can be seamed by both the Rosso method and the linking method even if the point needles P are not inserted through all the linking loops K to be seamed. Consequently, the starting portion and end portion of the seaming can be terminated firmly. In addition, the linking part can be firmly seamed by the conventional linking method with no deterioration in fit.

In the foregoing preferred embodiment, steps S1 to S5 are preferably performed manually. Nevertheless, all the steps may be automated by performing the operations of conveying the circular knitted fabric W to between the holding plates and loading the point needles P into the grooves by means of a robot or other mechanism, and pressing the holding plate 20*b* against the holding plate 20*a* by means of a cylinder, an actuator, or other suitable device.

The present preferred embodiment has dealt with the case of sewing circular knitted fabric, whereas the present invention, though needless to say, is also applicable to sewing flat knitted fabrics.

In this preferred embodiment, both the holding plates 20*a* and 20*b* are preferably provided with the projections 22*a*, 22*b*. However, projections need not necessarily be formed on both. Moreover, projections need not be formed at all if the knitted fabric is such that the linking loops K will not fall easily when the point needles P are pulled out. In this case, the holding plates 20*a* and 20*b* are preferably marked for the arrangement of the knitted fabric so as not to cause a shift in the starting position of seaming.

Figure 8:
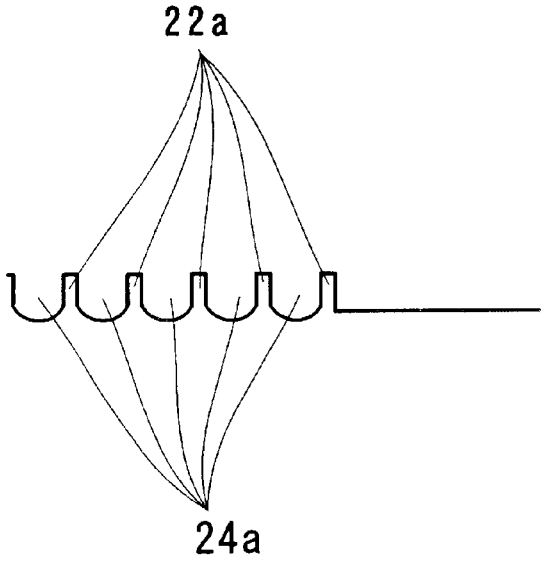
FIG. 8 is a schematic enlarged front view of the top surface of an alternative holding plate.

In this preferred embodiment, the grooves 24*a*, 24*b* formed between the projections 22*a*, 22*b* have flat bottoms. Nevertheless, the bottoms of the grooves 24*a*, 24*b* are not limited thereto but may be formed to trace arcs as shown in FIG. 8. In this case, the linking loops K are supported with areas larger than in the foregoing preferred embodiment. This can ensure that the linking loops K stand upright. FIG. 8 is a schematic enlarged view of the top surface of the alternative holding plate.

As has been described, according to preferred embodiments of the present invention, seaming can be performed without inserting point needles through linking loops that are formed near the ends of the course direction. Besides, the other linking loops can be automatically linked with efficiency.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A sewing method for seaming knitted fabrics having linking loops on top courses thereof, said knitted fabrics being stretched in a course direction with point needles inserted through some successive ones of said linking loops, the method comprising the steps of:

holding said knitted fabrics in a vicinity of said linking loops across the course direction;

pulling out said point needles with said knitted fabrics being held;

seaming linking loops not having been pierced with said point needles at intervals smaller than the intervals of arrangement of said linking loops not having been pierced with said point needles; and seaming said linking loops having been pierced with said point needles by linking.

2. The sewing method according to claim 1, comprising the steps of:

arranging said knitted fabrics between holding members for holding said knitted fabrics therebetween; and locking said point needles to end surfaces of said holding members.

3. The sewing method according to claim 2, wherein at least one of said holding members has, on an end surface thereof, a plurality of projections for making contact with a knitting yarn constituting said linking loops.

* * * * *